US007509953B2

(12) United States Patent
Wood

(10) Patent No.: US 7,509,953 B2
(45) Date of Patent: Mar. 31, 2009

(54) AIR RELEASE AND BOLT DESIGN FOR A PAINTBALL MARKER

(75) Inventor: Jack Kingsley Wood, Chesire (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 5 days.

(21) Appl. No.: 11/692,454

(22) Filed: Mar. 28, 2007

(65) Prior Publication Data

US 2007/0227519 A1 Oct. 4, 2007

Related U.S. Application Data

(60) Provisional application No. 60/743,918, filed on Mar. 29, 2006.

(51) Int. Cl.
*F41B 11/32* (2006.01)

(52) U.S. Cl. ..... 124/73

(58) Field of Classification Search ..... 124/71–77
See application file for complete search history.

(56) References Cited

U.S. PATENT DOCUMENTS

| | | | | |
|---|---|---|---|---|
| 5,613,483 | A | 3/1997 | Lukas et al. | |
| 5,878,736 | A | 3/1999 | Lotuaco, III | |
| 6,035,843 | A | 3/2000 | Smith et al. | |
| 6,065,460 | A | 5/2000 | Lotuaco, III | |
| 6,557,542 | B1 | 5/2003 | Orr | |
| 6,601,780 | B1 | 8/2003 | Sheng | |
| 6,644,295 | B2 * | 11/2003 | Jones | 124/73 |
| 6,810,871 | B2 * | 11/2004 | Jones | 124/73 |
| 6,901,923 | B2 * | 6/2005 | Jones | 124/73 |
| 6,925,997 | B2 | 8/2005 | Sheng | |
| 7,044,119 | B2 * | 5/2006 | Jones | 124/74 |
| 7,121,272 | B2 * | 10/2006 | Jones | 124/77 |
| 7,185,646 | B2 * | 3/2007 | Jones | 124/74 |
| 2004/0144377 | A1 | 7/2004 | Dobbins | |
| 2005/0115554 | A1 | 6/2005 | Jones | |
| 2007/0028909 | A1 * | 2/2007 | Wood | 124/73 |

FOREIGN PATENT DOCUMENTS

WO 9212395 A1 7/1992

* cited by examiner

*Primary Examiner*—Troy Chambers
*Assistant Examiner*—Jonathan C Weber
(74) *Attorney, Agent, or Firm*—Barlow, Josephs & Holmes, Ltd.

(57) ABSTRACT

The pneumatic launching assembly includes a launching body with a front end and a rear end. A first chamber is positioned in the rear end of the launching body for isolating a gas supply. A bolt is positioned in the front end of the launching body for moving a projectile into a launching position. A second chamber is coaxially forward of the first chamber for isolating the gas supply until the bolt is in a fully forward position. A firing plunger is slidably mounted in the launching body and moveable within the bolt and first chamber for regulating gas flow. In operation, the bolt moves forwardly to position the projectile into a launching position, meanwhile, the firing plunger moves rearwardly to release an gas to propel the projectile. The bolt and firing plunger are coaxially moving in opposite directions to minimize any recoil of the pneumatic launching assembly.

12 Claims, 5 Drawing Sheets

AIR RELEASE AND BOLT DESIGN FOR A PAINTBALL MARKER

CROSS REFERENCE TO RELATED APPLICATION

This application is related to and claims priority from earlier filed provisional patent application Ser. No. 60/743,918, filed Mar. 29, 2006 and incorporated herein by reference.

BACKGROUND OF THE INVENTION

In the prior art, gas powered guns or markers are well known in the art. In general these devices include a supply of gas that fills a chamber which is then emptied to launch a projectile, namely, a paintball. Valving is typically provided in the marker to control the flow of gas therein. In the prior art, electrically operated solenoid valves and mechanical valves have been employed for this purpose. One example of such a mechanical valve used in paintball markers is a "spool" valve. These are so well known that they need not be discussed in detail herein.

Gas within a marker not only provides power for launching a projectile but also is commonly used to control loading and launching of the projectile. In other words, gas can also be used to control bolt movement within a marker to, in turn, control position of a paintball. There are number of prior art patents that use this concept. U.S. Pat. Nos. 6,035,843 and 5,613,483 both use the existing gas supply for bolt control. In these sample prior art systems, a unitary bolt construction is used for the dual purpose of controlling flow of gas to a storage chamber to serve as the power to launch the projectile and as well as serving as a conventional bolt that moves the projectile to a launch position while preventing additional projectiles from entering the breech.

Essentially, the prior art bolt unitary constructions have a standard bolt at one end and a gas control at the opposing end. The bolt reciprocates back and forth within the marker. With the appropriate timing, gas fills the appropriate chamber within the bolt assembly when the bolt construction is rearwardly positioned. When the bolt moves forward, the paintball is moved forward into a launching position. This forward motion causes the appropriate passageways within the marker to open so that the stored gas is released behind the paintball so that it can be launched.

While these prior bolt constructions effectively control gas flow and launching of a paintball, they suffer from many disadvantages. These prior art bolt designs do not allow for the isolation of supply gas from the first chamber during the firing/launching step and to allow refilling of the gas storage chamber during re-loading. Since the bolt portion and the gas flow control portion, at the opposing end, are connected to each other, they reciprocate together resulting in a bolt assembly that is always imbalanced within the marker. Also, each time these parts hit the end of their travel they impart energy into the body and cause it to "rock" around its centre of inertia. This undesirably results in a noticeably recoil and click each time the bolt reciprocates back and forth.

In view of the foregoing, there is a need to improve a marker construction to eliminate or reduce recoil associated with paintball markers and other gas powered projectile launchers. There is also a need to provide a bolt system that is balanced during operation. There is a further need for a marker that is self-timed to avoid misfirings. Also, there is a need to isolate the supply gas from the rest of the gas chambers within the marker.

SUMMARY OF THE INVENTION

An embodiment of the present invention preserves the advantages of prior art gas powered guns or markers. In addition, it provides new advantages not found in currently available gas powered guns or markers and overcomes many disadvantages of such currently available gas powered guns or markers.

The embodiment is generally directed to a novel and unique pneumatic launching assembly. The pneumatic launching assembly consists of a launching body, located within the pneumatic launching assembly, with a front end and a rear end. A first chamber, having a front end and rear end, is located at a rear end of the launching body for isolating a gas supply. A bolt is positioned at the front end of the launching body. The bolt is movable between a loading position, to receive a projectile, and a launching position, that moves a projectile into a launching position. Until the bolt is in a launching position, a second chamber, located at the front end of the first chamber, isolates the gas supply. A rear end of the bolt has a seal disposed over an exterior surface thereof to seal a front end of the second chamber.

A firing plunger is slidably mounted at the rear end of the launching body and moveable within the bolt and first chamber. A first region of the firing plunger has a shape suitable for slidable movement within the bolt. A second region of the firing plunger is slotted to allow the release of the isolated gas supply from the first chamber and through the barrel. A third region of the firing plunger is configured for an air-tight fit within a sealing member located at the front end of the first chamber to isolate a gas supply. A fourth region of the firing plunger is smaller than the third region of the firing plunger to maximize the volume of gas isolated within the first chamber. A fifth region of the firing plunger has a sealing member disposed over an exterior surface thereof to seal the rear end of the first chamber when the fifth region of the firing plunger and the launching body overlap. A sixth region of the firing plunger has notches to receive gas which moves the firing plunger to a rearwardly position. A seventh region of the firing plunger has a shape suitable for recoiling against the launching body to return the firing plunger to its forward position.

In operation, the bolt moves forwardly to position the projectile into a firing position within the barrel, meanwhile, the firing plunger moves rearwardly to release the isolated gas supply from the first chamber to propel the projectile, the bolt and firing plunger coaxially moving in opposite directions to minimize any recoil of the pneumatic launching assembly.

It is therefore an object of the embodiment to provide a pneumatic launching assembly that eliminates or reduces recoil.

It is a further object of the embodiment to provide a pneumatic launching assembly that is self-timed to avoid misfirings in a closed system.

Another object of the embodiment to provide a pneumatic launching assembly that provides isolation of a supply gas to improve overall efficiency of pneumatic launching assembly.

BRIEF DESCRIPTION OF THE DRAWINGS

The novel features which are characteristic of the pneumatic launching assembly are set forth in the appended claims. However, the pneumatic launching assembly, together with further embodiments and attendant advantages, will be best understood by reference to the following detailed description taken in connection with the accompanying drawings in which:

DETAILED DESCRIPTION OF THE PREFERRED EMBODIMENTS

Figure 1:
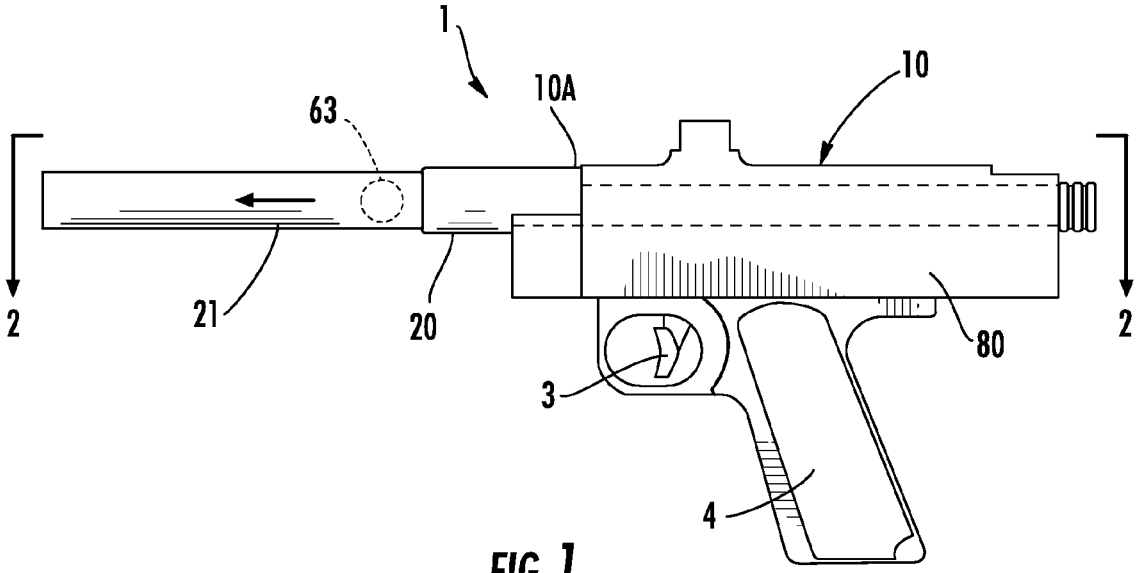
FIG. 1 is a side view of a paintball marker of the present invention.

Referring now to FIG. 1, a paintball maker 1 is shown to provide context for the present invention. The paintball marker 1 includes a trigger mechanism 3 for activating a series of solenoid valves (not shown) that releases gas from a gas supply 80, at the appropriate time, into a pneumatic launching assembly 10. It should be noted the trigger mechanism may consist of other types of actuation means other than solenoid valves. Triggering of the release of gas in such pneumatic launching assemblies is so well known that they need not be discussed in further detail herein.

A handle 4 is permanently attached to the trigger mechanism 3 to provide support for a user in aiming the paintball marker 1 at a target and pulling the trigger mechanism 3. The trigger mechanism 3 and the handle 4 are affixed to the bottom of a pneumatic launching assembly 10, the present invention.

Figure 2:
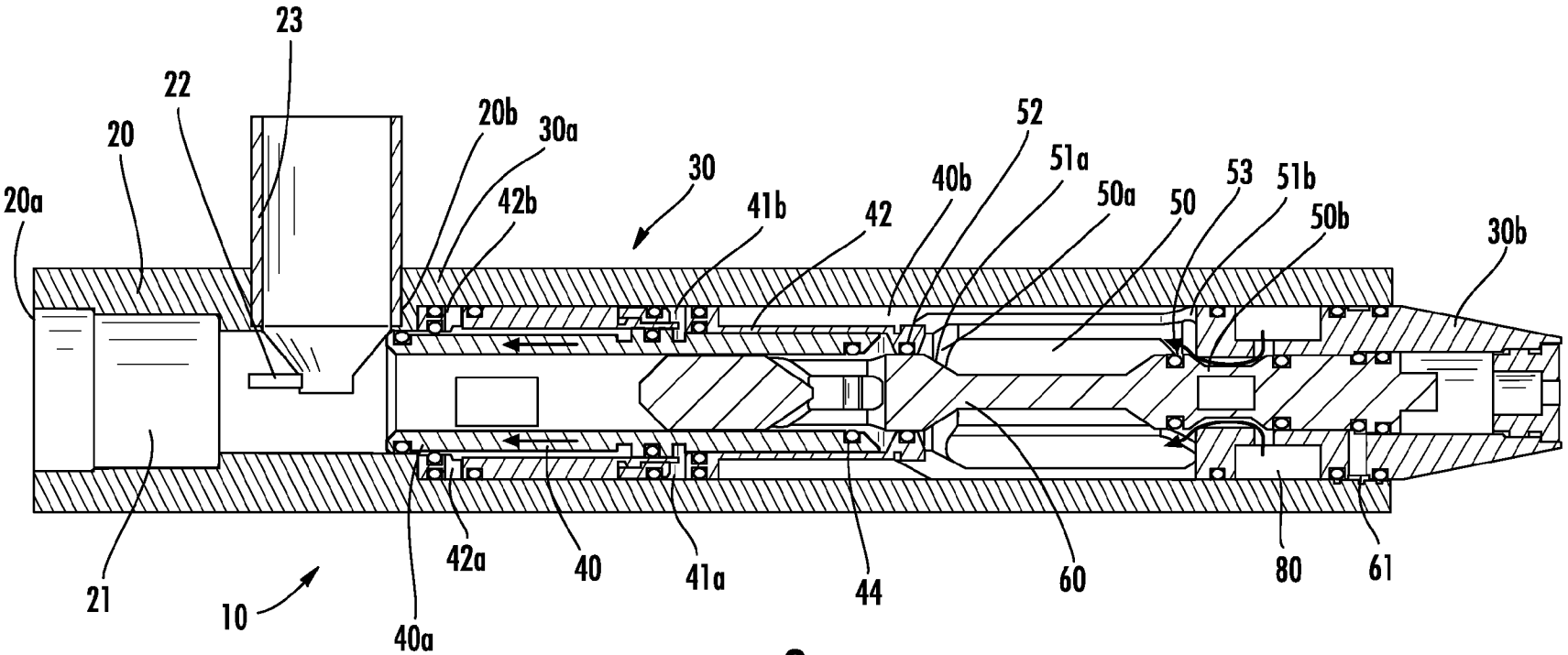
FIG. 2 is a cross-sectional view through the line 2-2 of FIG. 1 of the pneumatic launching assembly with the bolt in a rearward position.

Now referring to FIG. 2, the pneumatic launching assembly 10 has a barrel 20 affixed to a front end 10*a* of the pneumatic launching assembly 10. The barrel 20 contains a bore 21 which guides the projectile 63 out a front end 20*a* of the barrel 20. At a rear end 20*b* of the barrel 20, the barrel 20 contains a breech 22 connected to a projectile feeding tube 23 where the projectiles 63 are loaded. The projectile feeding tube is disposed above the breech 22 for connecting with a tank (not shown) to supply projectiles 63 at a predetermined time. The projectile 63 is loaded from the breech 22 and into the barrel 20 for launching the projectile 63 after activation of the pneumatic launching assembly 10. The material used for the barrel is impermeable to gas. A projectile 63, which is preferably spherical in form, may be used such as a paintball.

Still referring to FIG. 2, the pneumatic launching assembly 10 is shown in preparation for loading of the projectile 63. The pneumatic launching assembly 10 may be used within a paintball marker 1 or other gas powered projectile launcher. The pneumatic launching assembly 10 consists of materials such as lightweight plastics or alloys with sufficient strength to withstand high pressure upon launching of the projectile 63.

The pneumatic launching assembly 10 includes a launching body 30, a bolt 40, a first chamber 50, and a firing plunger 60. The launching body 30 has both a front end 30*a* and a rear end 30*b*. The front end 30*a* of the launching body 30 is connected to, or formed integrally, with the rear end 20*b* of the barrel 20. A front end 30*a* of the launching body 30 is constructed as a hollow tube that connects with the barrel 20 by various means.

The bolt 40 is slidably mounted within the front end 30*a* of the launching body 30. The bolt 40 slidably moves along a bolt guide 43 which has a horizontal axis. The bolt 40 is a hollow cylinder which allows the movement of gas through the bolt 40 and into the barrel 20. In addition, the bolt 40 has sufficient diameter to allow the firing plunger 60 to slidably move within the hollow center of the bolt 40. A front end 40*a* of the bolt 40 is configured to engage the projectile 63, while preserving the integrity of the projectile 63, to move it into a launching position within the barrel 20. The bolt 40, in another embodiment, contains a sealing member 44, such as an o-ring, disposed over the exterior surface of a rear end 40*b* of the bolt 40.

Figure 4:
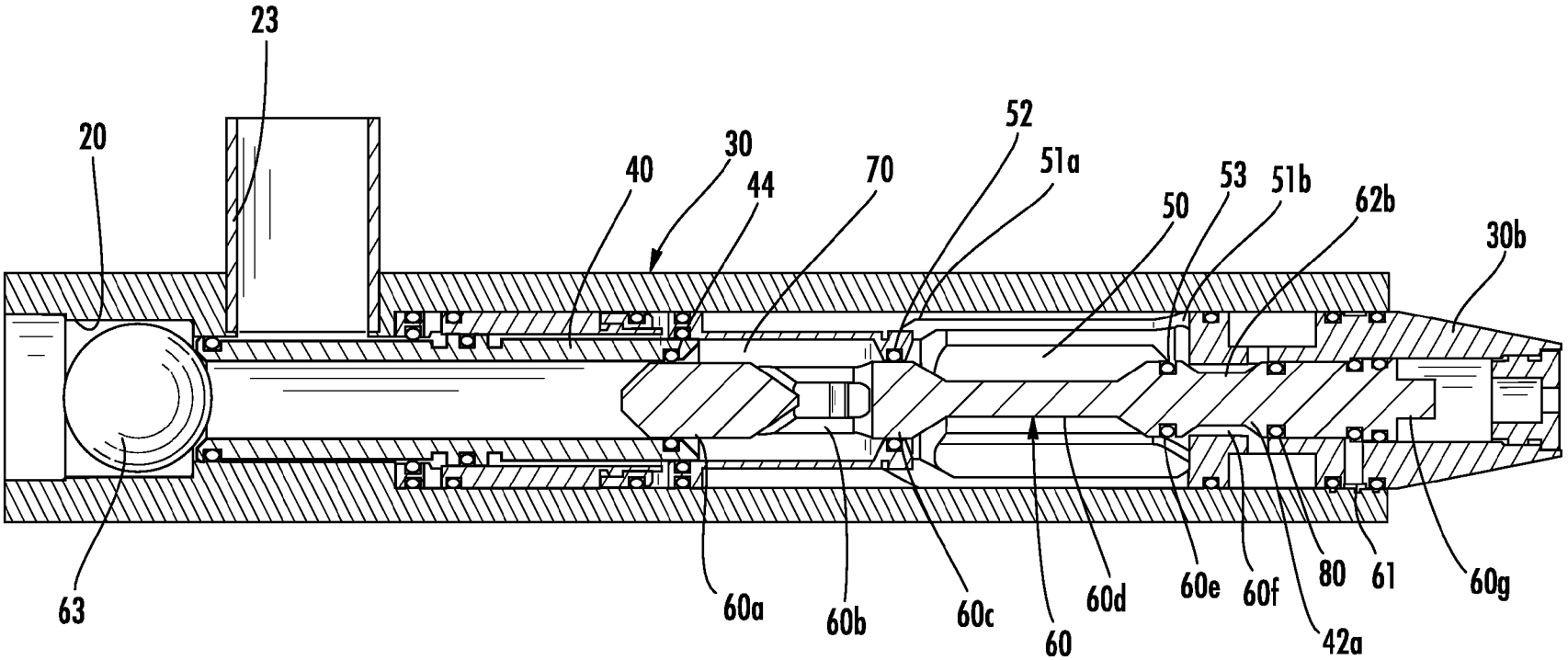
FIG. 4 is a cross-sectional view through the line 2-2 of FIG. 1 of the pneumatic launching assembly with the bolt in a forward position.

The bolt guide 43 contains gas pathways 41*a*, 41*b*, 42*a*, 42*b* arranged through a lateral sidewall of the bolt guide 43. Movement of the bolt 40 can be controlled by directing gas to, and venting gas from, alternating sides of the bolt guide 43 through the gas pathways 41*a*, 41*b*, 42*a*, 42*b* with the assistance of solenoid valves (not shown). The gas pathways 41*a*, 41*b*, 42*a*, 42*b* are used to provide gas from the gas supply 80 to actuate the bolt 40 forward or rearward. To move the bolt 40 forward, gas is supplied to the rear end 40*b* of the bolt 40 through the gas pathways 41*a*, 41*b*, which moves the projectile 63 into a launching position. Once the bolt 40 moves forward, as seen in FIG. 4, the projectile 63 is moved from the breech 22 and positioned into the barrel 20 for launching. After launching the projectile 63, the bolt 40 moves rearwardly when gas is provided to the front end 40*a* of the bolt 40 through the gas pathways 42*a*, 42*b*, which moves the bolt 40 into a rearward position.

Still referring to FIG. 2, the launching body 30 contains a first chamber 50 to isolate a gas supply. The first chamber 50 is bordered by the walls of the launching body 30 with an aperture 50*a* at a front end 51*a* of the first chamber 50 and an aperture 50*b* at a rear end 51*b* of the first chamber 50. Both the front 50*a* and rear 50*b* apertures of the first chamber 50 have sufficient diameter to allow slidable movement of the firing plunger 60 through the apertures. The front end 50*a* of the first chamber 50 contains a sealing member 52, such as a 0-ring, to provide an air-tight fit when overlapping the firing plunger 60, as described below.

The first chamber 50 is used in a closed system to conserve the gas supply 80. The first chamber 50 occupies a volume of space suitable for isolating gas that can propel a projectile 63 out of the front end 20*a* of the barrel 20. A gas supply 80 for the first chamber 50 is provided from a canister (not shown) or other container used to contain compressed gas, which may be attached directly to the pneumatic launching assembly 10 or may be attached to a person or other object.

Still referring to FIG. 2, a firing plunger 60 is slidably mounted at a rear end 30*b* of the launching body 30. The firing plunger 60 is moveable along a horizontal axis within the first chamber 50 to regulate the isolated gas contained within the first chamber 50. The firing plunger 60 consists of a long tube with a varying diameter and shape along its length.

Figure 3:
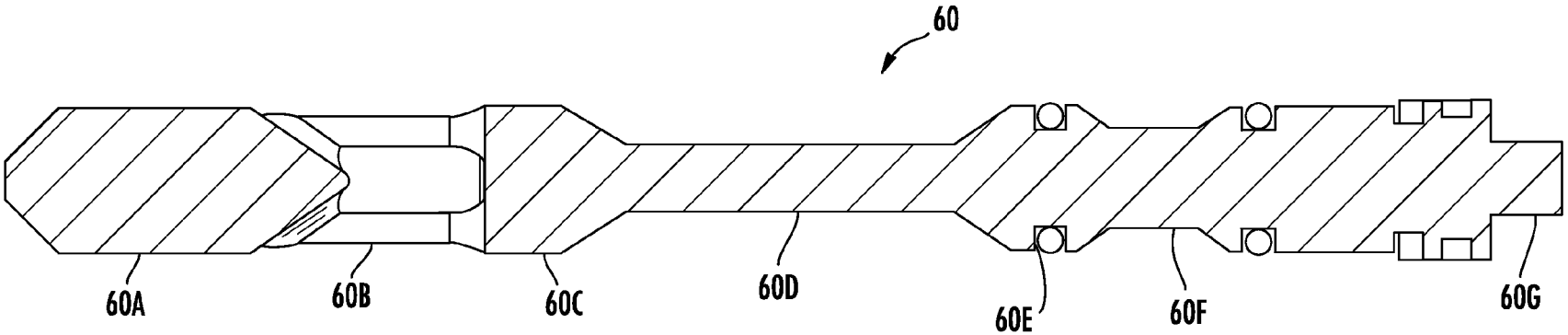
FIG. 3 is a cross-sectional view through the line 2-2 of FIG. 1 of the firing plunger alone used within the pneumatic launching assembly.

The firing plunger 60 is a unitary structure with seven regions, as seen in FIG. 3. The seven regions of the firing plunger 60 are shown as 60*a*, 60*b*, 60*c*, 60*d*, 60*e*, 60*f*, and 60*g*. Now referring to FIG. 4, a pneumatic launching assembly 10 is in a position that shows a projectile 63 ready for launch. A first region 60*a* of the firing plunger 60 has a shape suitable for slidable movement within the hollow center of the bolt 40. The first region 60*a* of the firing plunger 60 is smaller in diameter than the bolt 40 to permit horizontal movement within the bolt 40. When the sealing member 44 of the bolt 40 and the first region 60*a* of the firing plunger 60 overlap, a second chamber 70 is formed to isolate the gas released from the first chamber 50.

The second chamber 70 ensures that the bolt 40 is fully forward, and thereby not aligned or overlapping with the first region 60*a* of the firing plunger 60, before any gas reaches the breech 22 and attempts to move the projectile 63 into the barrel 20. The second chamber 70 is a temporary holding area for isolating the gas, from the first chamber 50, before its release through the bolt 40 and out of the barrel 20. By temporarily holding gas within the second chamber 70, the gas pushes the bolt 40 fully forward to seal off the projectile feeding tube 23. By ensuring the bolt 40 is fully forward, it ensures that one projectile 63 enters the breach 22 at a time to avoid misfirings. If the bolt 40 is partially closed, more than one projectile 63 may move prematurely and jam against the launching body 20, thus weakening the overall integrity of the projectile 63. When the integrity of the projectile 63 is weakened, the projectile 63 may lose its form sufficiently to prevent the projectile 63 from exiting the front end of the barrel 20*a*.

The second region 60*b* of the firing plunger 60 is slotted to allow the release of the isolated gas from the first chamber 50 and through the barrel 20. When the second region 60*b* of the firing plunger 60 is aligned with the sealing member 52 located on a front end 51*a* of the first chamber 50, gas moves from the first chamber 50 and through the bolt 20.

The third region 60*c* of the firing plunger 60 is configured to fit within the sealing member 52 located at the front end 51*a* of the first chamber 50 to isolate gas. The firing plunger 60 and the sealing member 52 located on the front end 51*a* of the first chamber 50 provide an air-tight fit when properly aligned with the firing plunger 60.

The fourth region 60*d* of the firing plunger 60 has a smaller diameter than the third region 60*c* of the firing plunger 60 to maximize the volume of gas isolated within the first chamber 50.

The fifth region 60*e* of the firing plunger 60 is disposed with a sealing member 53 on the exterior surface thereof to seal a rear end 51*b* of the first chamber 50 when the firing plunger 60 and launching body 30 overlap. When the fifth region 60*e* of the firing plunger 60 moves rearwardly, the firing plunger 60 prevents gas from reaching the first chamber 50. The fifth region of the firing plunger 60*e* along with the sealing member 53 provides an air-tight fit within the walls of the rear end 30*b* of the launching body 30 to prevent gas from entering the first chamber 50.

The sixth region of the firing plunger 60*f* has notches 62*a*, 62*b* that allow gas to move from the gas supply 80 and into the first chamber 50. Once the fifth region 60*e* of the firing plunger 60 moves rearward and is aligned with the sealing member 53, the gas supply 80 is prevented from moving along the notches 61*a*, 61*b* and into the first chamber 50.

The seventh region 60*g* of the firing plunger 60 has a shape suitable for recoiling against the rear end 30*b* of the launching body 30.

The seventh region 60*g* contacts the rear end 30*b* of the launching body 30 which moves the firing plunger 60 back to its forward position.

In another embodiment, a firing plunger is a unitary structure with five regions. A first region of the firing plunger has a shape suitable for slidable movement within the bolt. The first region is smaller in diameter than the bolt to permit horizontal movement within the bolt. A second region of the firing plunger is slotted to allow the release of the isolated gas supply from a first chamber. When the second region of the firing plunger is aligned with the sealing member located on a front end of the first chamber, the slotted portion of the second region allows the isolated gas to move from the first chamber and through the bolt.

A third region of the firing plunger is configured to fit within the sealing member located at the front end of the first chamber to isolate gas. The third region of the firing plunger and the sealing member located on the front end of the first chamber provide an air-tight fit when overlapping. A fourth region of the firing plunger is smaller than the third region of the firing plunger to maximize the volume of gas isolated within the first chamber.

A fifth region of the firing plunger is situated within a sealing member to seal a rear end of the first chamber when the firing plunger and launching body overlap. When the firing plunger moves rearward, it closes the gas supply from reaching the first chamber. The firing plunger with the sealing member provides an air-tight fit with the rear end of the launching body to prevent further gas from entering the first chamber.

In another embodiment, the firing plunger is a unitary structure with three regions. A first region of the firing plunger has a shape suitable for slidable movement within a bolt. The first region is smaller in diameter than the bolt to permit horizontal movement within the bolt. A second region of the firing plunger is slotted to allow the release of an isolated gas supply. A third region of the firing plunger is smaller than the second region of the firing plunger to maximize the volume of gas isolated within the launching body.

An operation of a pneumatic launching assembly 30 is shown in FIGS. 2 to 5. A trigger mechanism 3 initiates a launch operation for actuation of the pneumatic launching assembly 10. Upon actuation of the pneumatic launching assembly 10, gas moves from the gas supply 80 and through the gas pathways 41*a*, 41*b* to move the bolt 40 from its rearward position, as seen in FIG. 2, to a forward launching position, in FIG. 4, after a projectile 63 has been loaded.

Referring now to FIG. 4, while the bolt is actuated forward, a projectile 63 is moved into a launching position within the barrel 20. During the launching operation, the bolt 40 moves forward under control of the gas pathways 41*a*, 41*b* by directing compressed gas to the rear end 40*b* of the bolt 40 while venting gas.

Meanwhile, the firing plunger 60 moves rearward in a coaxially opposed direction of the bolt 40 to minimize any recoil of the pneumatic launching assembly 10. To begin moving the firing plunger 60 rearward, a gas from the gas supply 80 is provided through a gas pathway 61. The firing plunger 60 controls the flow of gas into the first chamber 50. Once the firing plunger 60 moves sufficiently rearward, a sealing member 53 aligns with the launching body 30 to seal the first chamber 50 from receiving any more gas from the gas supply 80.

Next, as the firing plunger 60 continues to move rearward, the firing plunger 60 controls the flow of gas from the first chamber 50 and into the second chamber 70. Initially, the sealing member 52 and the firing plunger 60 are overlapping resulting in the sealing of the first chamber 50 and isolating gas. Once the firing plunger 60 moves sufficiently rearward, the front end 51*a* of the first chamber 50 is breeched by the second region 60*b* of the firing plunger 60, which allows gas to move from the first chamber 50 and into the second chamber 70.

Figure 5:
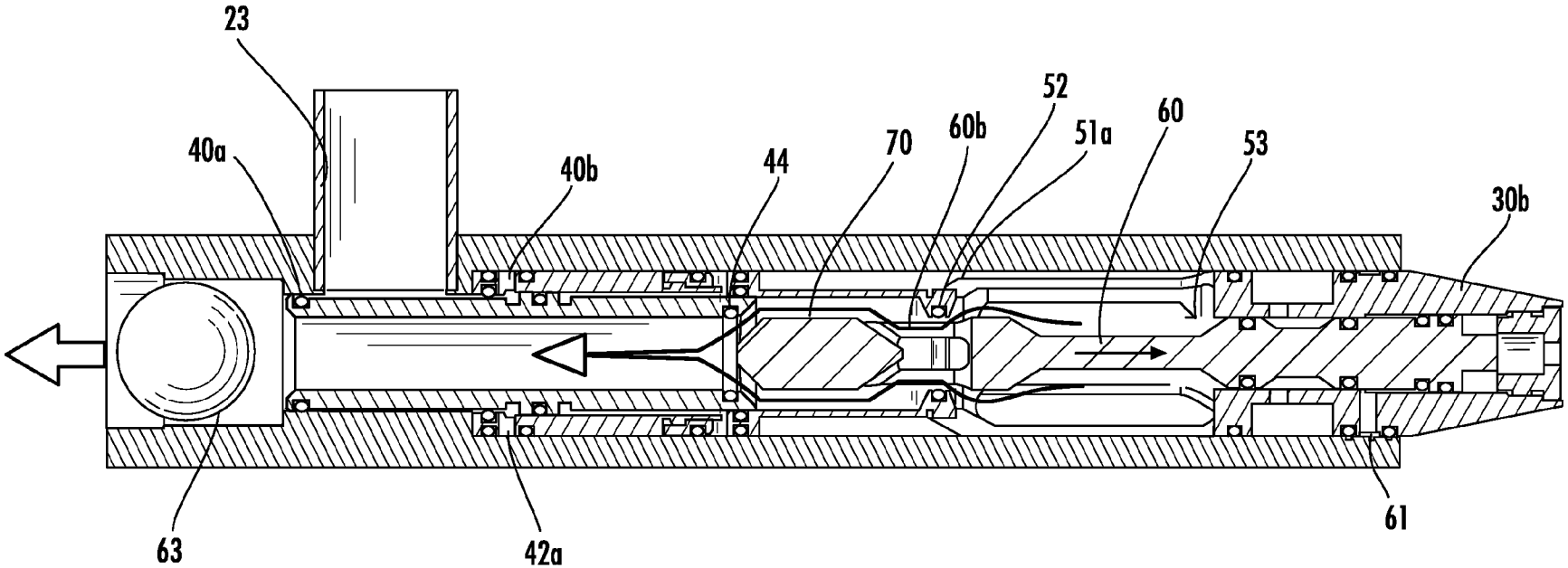
FIG. 5 is a cross-sectional view through the line 2-2 of FIG. 1 of the pneumatic launching assembly with the firing plunger moving rearward.

The firing plunger 60 also regulates the release of gas from the second chamber 70. The bolt 40, when aligned with a sealing member 44, seals the second chamber 70. If the bolt 40 is not fully forward blocking the projectile feeding tube 23, as seen in FIG. 3, the second chamber 70 temporarily isolates the gas. When the bolt is fully forward, as seen in FIG. 5, the projectile feeding tube 23 is blocked and the second chamber 70 opens and releases the gas contained within the second chamber 70. The gas, once released, travels through the bolt 40 to propel the projectile 63 forward and out of the barrel 20.

Once the gas has been released through the bolt 40, the firing plunger 60 returns to a rearward position. The rear end 30*b* of the launching body 30 returns the firing plunger after the gas, via the gas pathway 61, is terminated and vented. Meanwhile, the bolt is returned to its forward position by supplying gas through gas pathways 42*a*, 42*b* to the front end 40*a* of the bolt 40. It should be noted that gas could also be used to return the bolt 40 or firing plunger 60 to their respective positions as seen in FIG. 2.

Based on the disclosure above, a pneumatic launching assembly is configured that eliminates or reduces recoil by the bolt and firing plunger coaxially moving in opposite directions to minimize any recoil of the pneumatic launching assembly. In addition, the pneumatic launching assembly is self-timed to avoid misfirings in a closed system. Also, the pneumatic launching assembly provides isolation of gas to improve overall efficiency of the pneumatic launching assembly.

It would be appreciated by those skilled in the art that various changes and modifications can be made to the illustrated embodiments without departing from the spirit of the embodiments. All such modifications and changes are intended to be covered by the appended claims.

What is claimed is:

1. A pneumatic launching assembly, comprising: a launching body; a bolt disposed within the launching body and being movable between a loading position, to receive a projectile, and a launching position, that moves a projectile into a launching position; a firing plunger slidably mounted in the launching body and moveable within the bolt to regulate an isolated gas supply up through the launching body; and whereby the bolt is moved forward to position the projectile into a launching position, meanwhile, the firing plunger moves rearwardly to release an isolated gas supply to propel the projectile, the bolt and firing plunger coaxially moving in opposite directions to minimize any recoil of the pneumatic launching assembly.

2. A pneumatic launching assembly according to claim 1, further comprising: a first chamber, defined by the launching body, located at a rear end of the launching body for isolating a gas supply.

3. A pneumatic launching assembly according to claim 2, wherein the firing plunger is slidably movable within the first chamber to control the isolated gas supply within the first chamber.

4. A pneumatic launching assembly according to claim 2, further comprising: a second chamber, defined by the launching body, that is located in front of the first chamber for isolating the gas supply until the bolt is in a fully forward position.

5. A pneumatic launching assembly according to claim 4, wherein the rear end of the bolt has a sealing member disposed over an exterior surface thereof to seal a front end of the second chamber when the rear end of the bolt and the front end of the firing plunger overlap.

6. A pneumatic launching assembly according to claim 1, wherein a first region of the firing plunger has a shape suitable for slidable movement within the bolt.

7. A pneumatic launching assembly according to claim 1, wherein a second region of the firing plunger is slotted to allow the release of the isolated gas supply from the first chamber and up through the barrel.

8. A pneumatic launching assembly according to claim 1, wherein a third region of the firing plunger is configured for an air-tight fit within a sealing member located at a front end of the first chamber to isolate a gas supply.

9. A pneumatic launching assembly according to claim 1, wherein a fourth region of the firing plunger is smaller than the third region of the firing plunger to maximize the volume of gas isolated within the first chamber.

10. A pneumatic launching assembly according to claim 1, wherein a fifth region of the firing plunger has a sealing member disposed over the exterior surface thereof to seal a rear end of the first chamber when the fifth region of the firing plunger and launching body overlap.

11. A pneumatic launching assembly according to claim 1, wherein a sixth region of the firing plunger has notches to receive gas therethrough which moves the firing plunger to a rearward position.

12. A pneumatic launching assembly according to claim 1, wherein a seventh region of the firing plunger has a shape suitable for recoiling against the launching body to return the firing plunger to its original position.

* * * * *